US005413498A

United States Patent [19]

Ursich

[11] Patent Number: 5,413,498

[45] Date of Patent: May 9, 1995

[54] SELF-LOCKING FEMALE RECEPTOR FOR ELECTRICAL CORD

[76] Inventor: Nels E. Ursich, 6809 W. Brementowne Dr., Apt. 2W, Tinley Park, Ill. 60477

[21] Appl. No.: 176,663

[22] Filed: Jan. 3, 1994

Related U.S. Application Data

[63] Continuation-in-part of Ser. No. 911,752, Jul. 10, 1992, Pat. No. 5,281,162, which is a continuation of Ser. No. 719,930, Jun. 24, 1991, Pat. No. 5,129,836.

[51] Int. Cl.[6] ..... H01R 4/50

[52] U.S. Cl. ..... 439/346

[58] Field of Search ..... 439/134, 140, 345, 346, 439/347, 348, 369, 373

[56] References Cited

U.S. PATENT DOCUMENTS

| | | | |
|---|---|---|---|
| 1,404,098 | 1/1922 | Dennis | 439/270 |
| 2,198,504 | 4/1940 | Pool | 439/346 |
| 2,631,185 | 3/1953 | Earle et al. | 439/191 |
| 2,664,734 | 1/1954 | McEneaney | 439/134 |
| 2,732,531 | 1/1956 | Janowiec | 439/346 |
| 3,200,365 | 8/1965 | Carpinone | 439/346 |
| 4,179,175 | 12/1979 | Farnworth et al. | 439/348 |
| 4,566,297 | 1/1986 | Hawley | 439/348 |
| 4,784,611 | 11/1988 | Poulin et al. | 439/346 |
| 4,909,749 | 3/1990 | Long | 439/348 |

FOREIGN PATENT DOCUMENTS 0122842 10/1984 European Pat. Off. .

*Primary Examiner*—Khiem Nguyen
*Attorney, Agent, or Firm*—Edward D. Gilhooly

[57] ABSTRACT

A female receptor for locking a male plug and having an actuator element accessible from an exterior position. The actuator element comprises an elongated shaft having an area of reduced width to permit disengaging movement of internal balls mounted in the receptor body. The ball and balls retain the prongs of the male plug in place when the area of reduced width of the rod is not aligned with the ball and balls.

9 Claims, 3 Drawing Sheets

FIG. 1
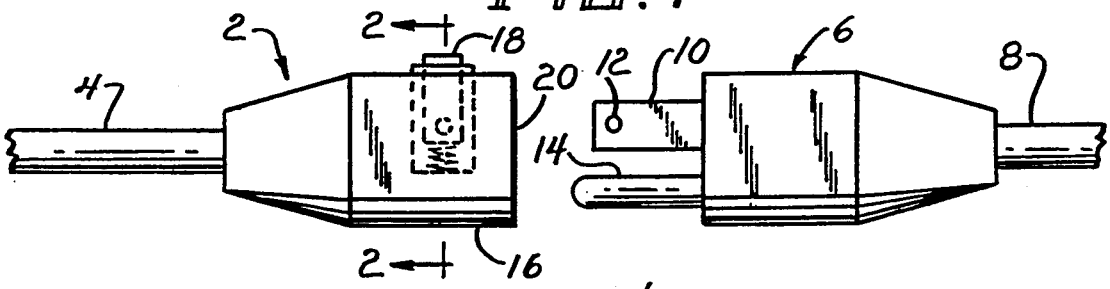
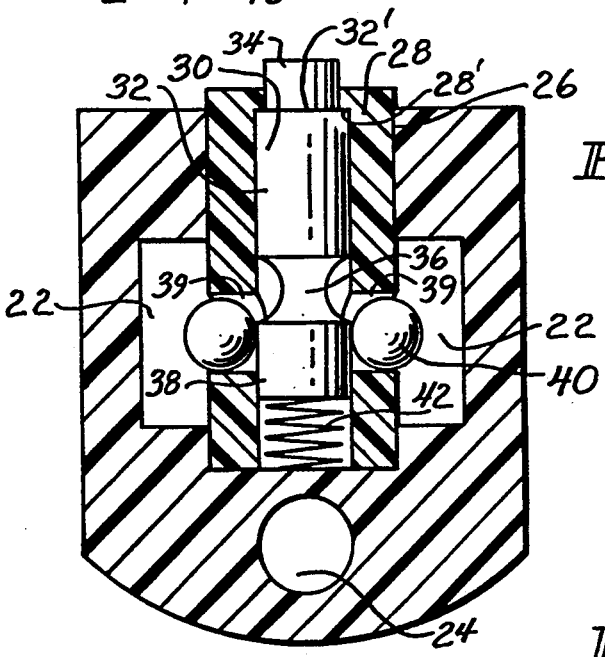
FIG. 2
FIG. 3
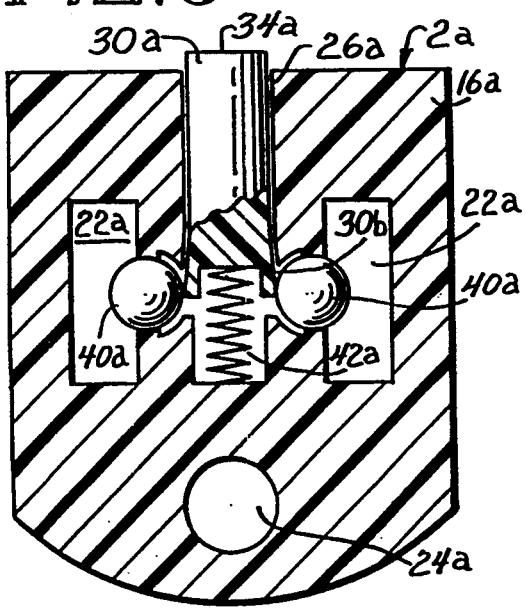
FIG. 4
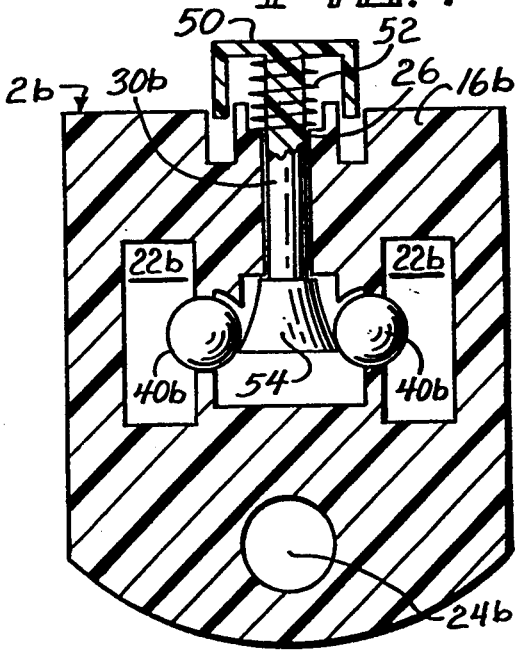

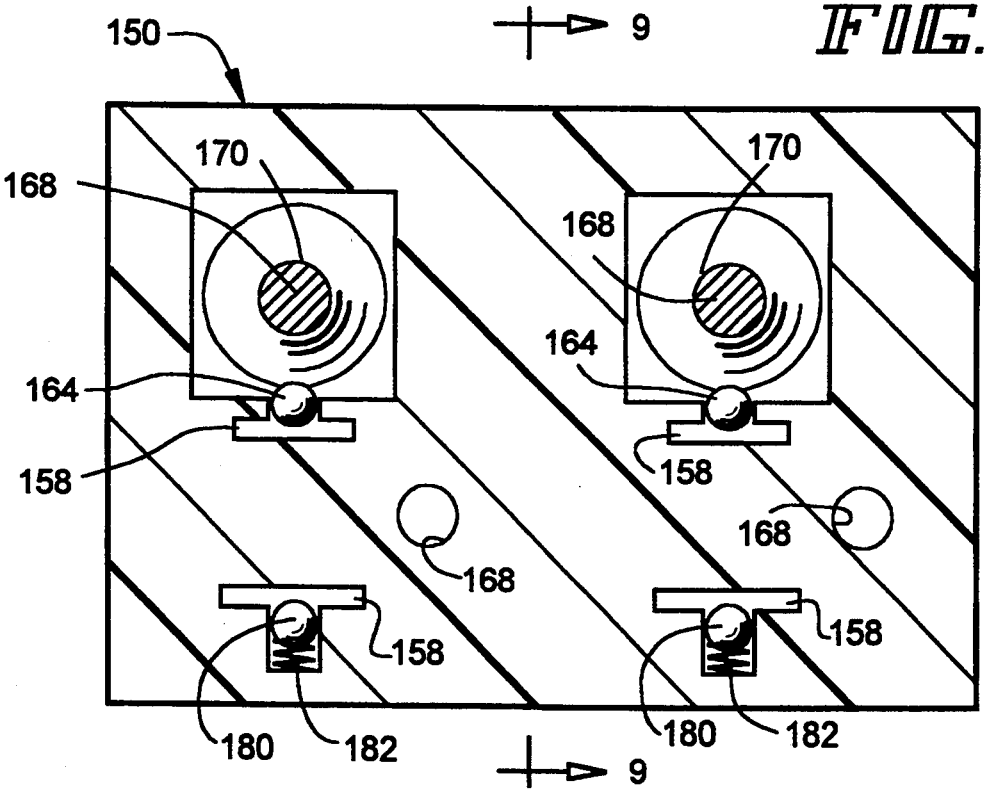
FIG. 8
FIG. 9
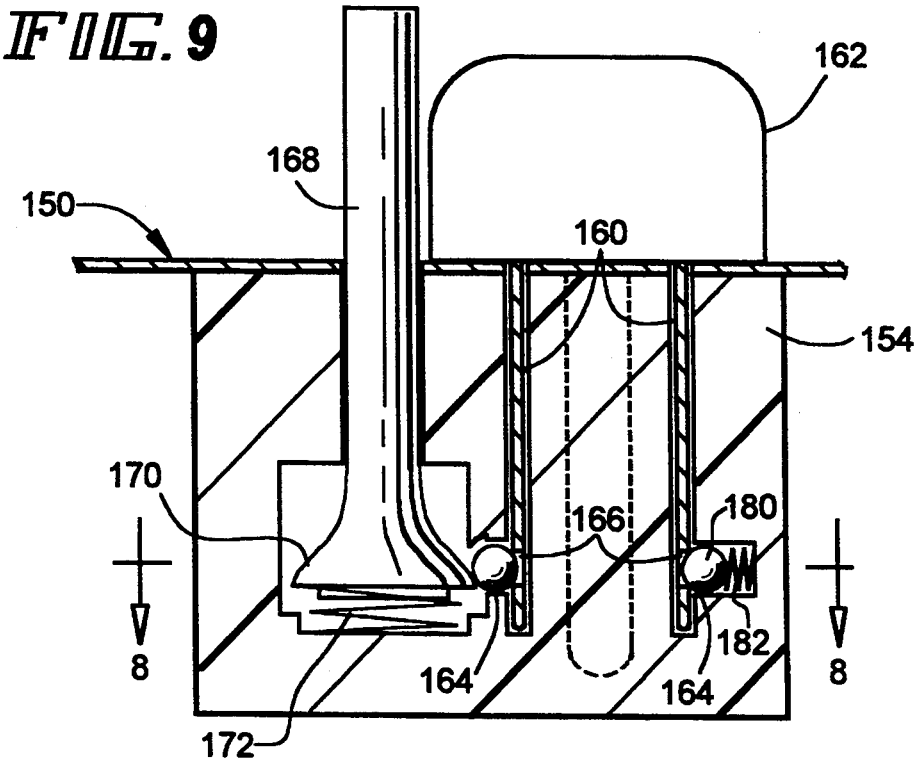

SELF-LOCKING FEMALE RECEPTOR FOR ELECTRICAL CORD

BACKGROUND OF THE INVENTION

This is a continuation in part of my application, Ser. No. 07/911,752 filed Jul. 10, 1992, now U.S. Pat. No. 5,281,162 which is in turn a continuation of Ser. No. 07/719,930 filed Jun. 24, 1991, now U.S. Pat. No. 5,129,836 issued Jul. 14, 1992.

FIELD OF THE INVENTION

This invention relates to electrical cords and, more specifically, to a self-locking female electrical receptor for an electrical cord.

SUMMARY OF THE PRIOR ART

A multitude of female receptor and male plugs have been introduced in the prior art to create a connection between electrical lines. For example, it is common to use extension cords by which electrical power can be delivered to a location remote from an electrical outlet or source of electrical potential. Extension cords are often used for many tasks, including in the home, at work and other locations. A persistent problem in the use of electrical connections between plugs and receptors results from the undesired disconnection of the plug from the socket during use. This can occur when an electrical device, such as a tool or other electrical equipment, must be manipulated in a fashion that the cord is pulled relative to the other cord and the plug is pulled out of its insertion in the female receptor. Such problems also exist for plugs inserted into a wall receptacle. An example of such an occurrence is present when a workman is on a roof using an electrical tool and as he operates the device, the extension cords or other lines become disconnected at a location near the ground. When such occurrences are presented, the workman must climb down the ladder and reconnect the male plug with the female receptor. Such occurrences are inconvenient, frustrating, and interfere with the productivity of the worker.

There have been attempts in the prior art to lock the plug into a female receptor so that a more secure electrical connection is created. Examples of prior art techniques for creating a locked relationship between male and female electric connectors are disclosed in U.S. Pat. Nos. 2,198,504 to Poole; 2,631,185 to Earle et al.; 2,664,734 to McEneaney; and 4,179,175 to Farnworth et al.; and 4,566,297 to Hawley. Although the devices in the foregoing patents disclose several techniques for creating a locking arrangement between a male plug and female receptor, the locking techniques of these patents do not provide an optimumly efficient and easy to use device. The locking functions of the patents of the foregoing prior art do not provide an easy connect disconnect to permit a user to engage and disengage the locking features by merely depressing an actuator. The prior art either requires elaborate elements to create a locking relationship, some of which are permanent in nature, or do not permit the ready disengagement as is needed in effective and efficient connection and disconnection. For these reasons, it is desirable to provide an improved electrical connection relationship between a female receptor and a male plug that is economic to manufacture, safe, and convenient to use.

SUMMARY OF THE INVENTION

It is an objective of the present invention to provide an effective and economical female electrical receptor which will efficiently lock a male plug element of an electrical line, cord, or female wall receptor to prevent accidental disconnection. The female receptor of the invention is provided with locking elements that are uniquely arranged to engage the typical punched holes provided in the male prongs of an electrical plug. Without other tools, the locking elements of the invention are locked in position by depression of an exterior arranged actuator which is also used to permit the plug to be easily removed. The receptor of the invention is highly efficient in use and is provided with safety features to prevent injury from shocks and the like.

BRIEF DESCRIPTION OF THE DRAWINGS

FIG. 1 is a side elevational view of the improved locking electrical female receptor of the invention adjacent a male electrical plug;

FIG. 2 is an end elevation view, with parts in section, of the female receptor of the invention of FIG. 1 taken along lines 2—2;

FIG. 3 is an end elevational view, with parts in section, of a second embodiment of the female receptor of the invention;

FIG. 4 is an end elevational view, with parts and section, of a third embodiment of the locking female receptor of the invention;

FIG. 8 is a front elevational view, with parts removed and parts in section, of a fifth embodiment of the locking female socket of the invention in the form of a wall receptor taken along FIGS. 8—8 of FIG. 9; and FIG. 9 is a top plan view, with parts removed and parts in section, of the fifth embodiment of the invention taken along lines 9—9 of FIG. 8.

DESCRIPTION OF THE PREFERRED EMBODIMENTS

Figure 5:
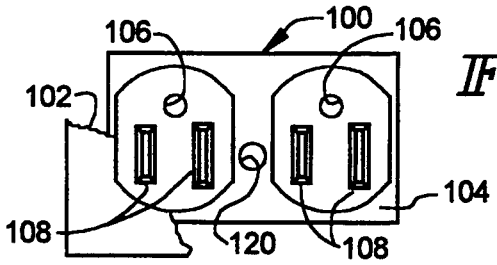
FIG. 5 is a front elevational view of a fourth embodiment of the locking socket of the invention in the form of a wall receptor.

Referring now to FIG. 1, there is illustrated the general arrangement of the improved locking female receptor of the invention for electrical cords which is generally designated by reference numeral 2. Electrical female receptor 2 is connected to a typical electrical line or cord 4 having an exterior electrical insulation. The female receptor 2 is intended to be interlocked with a male plug 6 which is attached to a second electrical line or cord 8. The male plug 6 and female receptor 2 can be attached to any conductive electrical lines, such as in connection with extension cords and other numerous uses well known in the art. The male plug 6 is conventionally provided with a pair of exterior prongs 10 formed from a metal conductive material. Each prong 10 includes a punched hole 12, and a ground prong 14 is also affixed to the male plug 6 as is well known.

The female receptor 2 of the invention is formed as a molded receptor body 16 from a suitable material, such as a molded plastic and the like, that is electrically non-conductive. The end face 20 of the female receptor body 16 is provided with a pair of plug holes 22 and a grounding hole 24 that are arranged to receive respectively the prongs 10 of the male plug 6 and the grounding prong 14. The insertion of the prongs 10 and grounding prong 14 into the female receptor 2 will result in an improved electrical connection being made between the respective electrical cords 4 and 8.

The receptor 16 is formed with a passage 26 that extends downward into the body 16 and is in communication with the plug holes 22. A cylindrical sleeve 28 is fixedly positioned within the hole 26 of the receptor body 16 and is also formed from an electrically non-conductive material. An elongated shaft 30 comprising an electrically non-conductive material, such as a plastic and the like, is movably positioned within the central passage 28' of sleeve 28. The elongated shaft 30 includes an upper portion 32 having a shoulder 32' to engage a flange 28' of the sleeve 28. An upper portion 34 of the movable shaft 30 provides a manual depressible actuator situated at an accessible exterior position on the body 16. An intermediate portion of the shaft 30 has a concentric area 36 having a reduced diameter and creating a profile to correspond to a spherical shape as will be apparent. The bottom portion 38 of shaft 30 is cylindrical in shape and has generally the same diameter as the internal passage 28' through sleeve 28 as is best shown in FIG. 2. A pair of openings 39 in the sleeve 28 capture a pair of balls 40 for limited movement outward from the holes 39 due to the reduction of the width of the openings 39 at the peripheral surface of the sleeve 26.

The balls 40 are permitted movement into the narrowed down portions 36 of the shaft 30 when the portions 36 are in confronting alignment with the sleeve openings 39 and the balls 40 are deflected towards the shaft 30. Such alignment occurs by depressing the upper actuator portion 34 of the shaft 30 for movement downward relative to the sleeve 26. A spring 42 insures that the plug 30 is returned to the upper position as shown in FIG. 2 when the upper portion 34 is released. It should be apparent, therefore, that the prongs 10 may be inserted into the plug openings 22 of receptor 2 when the shaft 30 is depressed for alignment of the narrowed down portion 36 with the openings 39 in sleeve 28. The plug prongs 10 therefore can deflect the balls 40 inward, and entry of the prongs 10 into the receptor 2 is possible.

The axial position of the balls 40 in the sleeve 22 is selected to correspond to the position of the prong holes 12 when the prongs 10 are fully inserted into the receptor 2. Therefore, as the upper actuator portion 34 is released, the lower portion 38 of the shaft 30 pushes and biases the balls 40 outward into a locking engagement with respective prong holes 12, such that a locked connection between female receptor 2 and male plug 6 is attained. Release of the male plug can only occur by again pressing shaft 30 at upper portion 34 to align the narrowed down portion 36 of shaft 30 with the balls 40, such that the balls can easily be deflected inwardly as the prongs 10 are pulled out for removal. Since the shaft 30 and sleeves 28 are formed from an electrically non-conductive material, such as plastic, the user is not exposed to the hazards of electrical shock when manipulating the external actuator portion 34. The spherical balls 40 are formed from a suitable metal or non-metallic material and the like, such as stainless steel, aluminum, ceramic, plastic, or any material that will resist corrosion during use.

Referring now to FIG. 3 there is illustrated a second embodiment of the locking female receptor 2 of the invention, generally designated by reference numeral **2*a*. The female receptor 2*a* includes a molded plastic body 16*a* having a hole 26*a* in which a shaft 30*a* extends downward. The shaft 30*a* is a solid, generally cylindrical plastic or any non-conductive material member, having a flared lower end 30*b* which is arranged to engage the pair of balls 40*a* provided in the female receptor body 16*a* as in the preceding embodiment described with reference to FIG. 2. The shaft 30*a* is resiliently biased upward by spring 42*a*. When the upper portion 34*a* of the shaft 30*a* is manually depressed, the flared bottom end 30*b* of the shaft 30*a* is oriented beneath the ball 40*a* to permit deflection of the balls when the plug prongs 10 are inserted into receptor holes 22*a*. Release of the shaft 30*a* will cause the flared end portions 30*b* to urge the balls 40 outwardly into biased engagement with the prong holes 12 of plug 6 as in the previous embodiment. Thus, to release the prongs 10 from the receptor, the shaft 30*a* must be depressed to bring a portion of the shaft 30*a* having a reduced diameter adjacent to balls 40*a* so that the balls can easily be deflected inward and the prongs 10 released for removal of the male plug 6**.

Referring now to FIG. 4 there is illustrated still another embodiment of the locking female receptor, generally designated by the reference numeral **2*b*. The embodiment of FIG. 4 also includes a molded receptor body 16*b*, a pair of plug prong holes 22*b* and a receptor hole 26*b* for receiving a shaft 30*b*. The shaft 30*b* includes a cylindrical central portion extending down into the receptor in hole 26*b* which hole is enlarged in a central portion of the receptor 16*b*. The shaft is provided with an upper actuating head 50 integrally affixed to shaft 30*b*. A biasing spring 52 is disposed between the actuator head 50 and the receptor body 16*b* in surrounding relationship to the shaft 30*b*. The bottom of the shaft 30*b* is provided with a flared out portion 54 having a maximum diameter at its bottom. In the position shown in FIG. 4, the flared out bottom portion 54 presses the balls 40*b* outward into locked relationship with the prong holes 12 of the plug 6. Thus, to insert the prongs 10 into the female receptor 2*b*, it is necessary to depress the shaft 30*b* so that the flared out portion 54 moves beneath the balls 40*b* and the prongs can deflect the balls inward toward the reduced diameter of the shaft 30*b*. Upon release of the shaft 32*b*, the spring 52 moves the shaft 30*b* upward to the position shown in FIG. 4 for pressing the balls 40*b* into contact with the prong holes 12 in a locking relationship as in the prior embodiment. Release of the plug 6 can be occasioned by depressing the shaft 32 which permits the balls 40*b* to be deflected in as the plug 6 is pulled out of its female receptor 2*b***.

Figure 6:
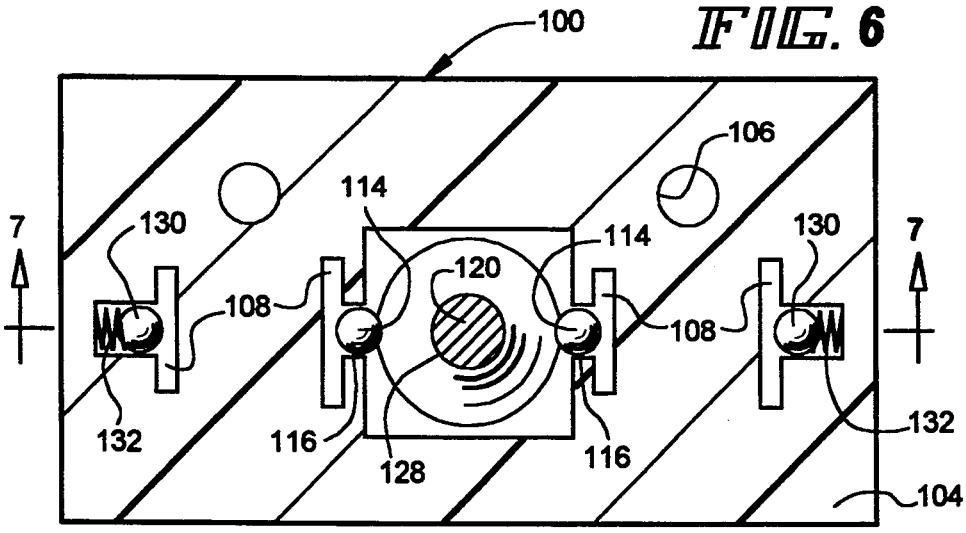
FIG. 6 is a front elevational view, with parts removed and parts in section, of the fourth embodiment of the form of FIG. 5 taken along lines 6—6 of FIG. 7.

Referring now to FIGS. 4, 5, and 6 there is illustrated another embodiment of the electrical female receptor of the invention in the form of a locking wall receptor 100. The locking wall receptor 100 includes a plate 102 and a socket body 104. The plate 102 also includes ground holes 106 for ground prongs for receiving the ground prongs of a male plug as conventional. The plate 102 is provided with two pairs of female openings 108 to receive the prongs 110 of a typical male plug 112 (FIG. 7) which is electrically connected to an electrical cord. The male plug 112 inserted in openings 108 creates an electrical connection with known conductive elements (not shown) positioned in socket body 104 and being connected to a source of alternating electrical current. Although the locking wall socket 100 is shown as having two pairs of male prong openings 108, the socket 100 may include one pair or more than two pairs of prong openings 108, if desired. The socket body 104 may be constructed from a non-conductive material, such as plastic and the like.

The receptor body 104 is provided with a pair of balls 114 suitably retained in passage 116 receptor body 104 for movement laterally toward and away from prongs 110 by retention means (not shown) of similar structure as shown in the preceding embodiments. A cylindrical actuator shaft 120 having a gradually enlarged end portion 122 (FIG. 7) extends through plate 102 into position between the outside edges of the male prongs 110. A suitable spring 124 resiliently biases the actuator shaft 120 outward, such that the balls 114 are urged in to respective locking relationship with the punched holes 126 of the male prongs 110 of the plug 112. The actuator shaft 120 may be depressed from the outside of plate 102 during insertion of the prongs 110 of either of the two male plugs 112 being attached to create an electrical connection. By depressing the shaft 120, its reduced diameter portion 128 is positioned adjacent to balls 114 to allow outward movement and clearance of balls 114, whereby the prongs 110 are easily insertable. Upon release of the actuator shaft 120 and its outward movement as provided by spring 124, the enlarged end portion 122 of the actuator shaft biases the balls 114 into contact with prong holes 126 to lock either one or both of the inserted plugs 112. To release the plugs 112, the actuator shaft 120 may simply be depressed. A pair of auxiliary balls 130 are mounted in body 104 and are resiliently biased laterally by spring 130 into a respective outer prong hole 126 to aid in retention of the respective male plug 112.

Figure 7:
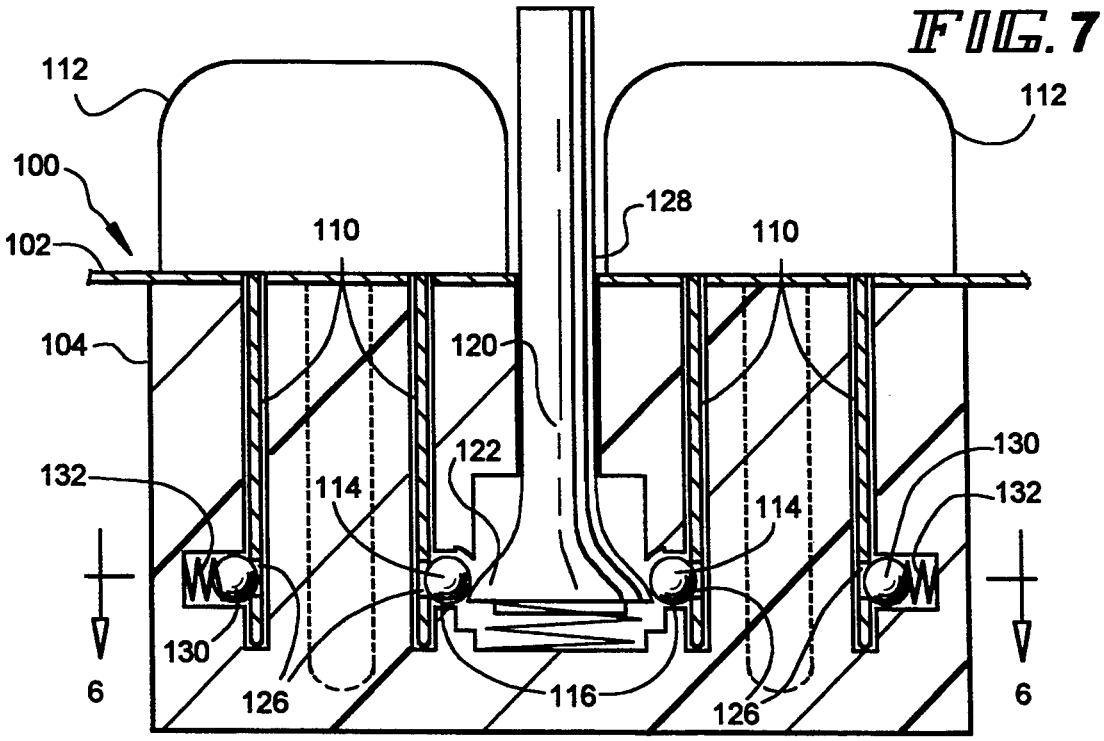
FIG. 7 is a top plan view, with parts removed and parts in section, of the fourth embodiment of FIG. 6 taken along lines 7—7 of FIG. 6.

Referring to FIGS. 7 and 8, there is illustrated still another embodiment of the electrical female socket of the invention in the form of a locking wall receptor 150. The locking wall receptor 150 includes a wall plate 152 and a socket body 154 formed of a non-conductive material. The plate 152 is provided with two pairs of opening 158 to receive the prongs 160 of a typical male plug 162 connected to an electrical cord (not shown). Electrical contacts (not shown) coupled to a source of electrical alternating current is mounted in socket body 154 and is intended to be in contact with the prongs 160. Although the locking wall receptor 150 is shown having two pairs of prong openings 158, the receptor 150 may include one pair or more than two pairs of prong openings 158.

The socket body 154 captures a pair of balls 164 in the preceding embodiments to engage the openings 166 of a male prongs 160 of a plug 161. Each of the balls 164 is biased by one of a pair of actuator shafts 168 each positioned in parallel relation to one of the prongs 160 and having an enlarged end portion 170. A pair of springs 172 respectively bias both actuator shafts 168 outward to cause the enlarged end portions 170 to deflect the balls 164 to engage the holes 166 of prongs 160. To insert or release a respective male plug 162, the actuator shafts 168 are depressed to position a narrow portion 170 of the actuator shaft 168 adjacent a ball 164 to allow release. A pair of auxiliary balls 180 are also resiliently biased by spring 182 into the other hole 166 of male prong 160 in the inserted position of a plug as described with reference to FIGS. 5 to 7.

In the foregoing embodiments of the invention, it should be apparent that the male plug is retained in a locked position in the female receptor or socket and can be released by a convenient actuator positioned exteriorly of the receptor or socket. The invention in the application provides an economical device that is easy to use and effective in maintaining a locked relationship between electrical cords and wall outlets for both reasons of convenience and safety.

What is claimed is:

1. A locking female electrical receptor comprising a female receptor body having a pair of holes for receiving a male plug having spaced prongs with punched holes for electrically connecting two electrical lines respectively coupled to said receptor body and the male plug, said receptor body having actuator means mounted for selective relative movement within said receptor body, said actuator means having a manually operated element being accessible from the outside of said receptor body, a pair of locking elements mounted in said receptor body in operative relationship to said actuator means at a position between the spaced prongs for selectively engaging the punched holes of the male plug locking the prongs of the male plug to said receptor body, said actuator means being movable along an axis parallel to the spaced prong to a first position between the spaced prongs for permitting insertion and removal of the prongs relative to said locking elements, and said actuator means being movable along said axis parallel to the spaced prongs to a second position between the spaced prongs in said receptor for rigidly urging said pair of locking elements outward in opposite directions into locking contact with the prongs of the male plug, said manual element having a greater width at said second position than at said first position.

2. A locking female electrical receptor comprising a receptor body having holes for receiving the spaced generally parallel prongs having punched holes of a male plug for electrically connecting an electrical line to a power source, said receptor body having actuator means mounted for selective relative movement within said socket receptor body, said actuator means being an elongated shaft extending into said receptor body and having an end portion positioned between said holes of said receptor body, said elongated shaft having an external portion accessible from the outside of said socket receptor body for manually causing said movement relative to said receptor body, at least one locking element mounted in said receptor body in operative relationship to said actuator means for selectively engaging at least one of the punched holes of the male plug locking the male plug to said receptor body, said elongated shaft being movable along an axis in parallel relationship to the parallel prongs to a first position during said movement for permitting insertion and removal of the prongs relative to said locking elements, said elongated shaft being movable along an axis in parallel relationship to the parallel prongs to a second position during said movement in said receptor for urging said at least one locking element into locking contact with at least one prong of the male plug, said elongated shaft having a variable width, and said elongated shaft having a greater width at said second position than in said first position.

3. A locking female electrical receptor comprising a receptor body having holes for receiving the spaced, generally parallel prongs having punched holes of a male plug for electrically connecting an electrical line to a power source, said receptor body having actuator means mounted for selective relative movement within said socket receptor body, said actuator means being an elongated shaft extending into said receptor body and having an end portion positioned within said receptor body, said elongated shaft having an external portion accessible from the outside of said socket receptor body for manually causing said movement relative to said receptor body, a locking element mounted in said receptor body in operative relationship to said actuator means for selectively engaging a punched hole of the male plug locking the male plug to said receptor body, said elongated shaft being movable along an axis in parallel relationship to the parallel prongs to a first position during said movement for permitting insertion and removal of the prongs relative to said locking element, said elongated shaft being movable along an axis generally in parallel relationship to the parallel prongs to a second position during said movement in said receptor for urging said locking element into locking contact with a prong of the male plug, said elongated shaft having a variable width, and said elongated shaft having a greater width at said second position than in said first position.

4. The locking female receptor according to claim 3 wherein said receptor body forms an electrical wall unit.

5. The locking female receptor according to claim 3 wherein said female receptor includes a plurality of pairs of holes for respectively receiving the spaced prongs of a male plug.

6. The locking female receptor according to claim 5 wherein said elongated shaft is capable of urging a plurality of locking elements respectively into locking contact with at least one prong of a plurality of male plugs inserted in said plurality of pairs of holes.

7. The locking female receptor according to claim 5 further comprising a second actuator in operative contact with a second locking element, said second actuator being a shaft having a variable width for permitting insertion and removal of a male plug having prongs inserted in one of said plurality of pairs of holes, said second actuator being movable to a locking position created by increased width of said shaft for urging said second locking element into locking contact with the prong of a male plug.

8. A locking female electrical receptor comprising a receptor body having holes for receiving the spaced, generally parallel prongs having punched holes of a male plug for electrically connecting an electrical line to a power source, said receptor body having actuator means mounted for selective relative movement within said socket receptor body, said actuator means being an elongated shaft extending into said receptor body and having an end portion positioned within said receptor body, said elongated shaft having an external portion accessible from the outside of said socket receptor body for manually causing said movement relative to said receptor body, a locking element mounted in said receptor body in operative relationship to said actuator means for selectively engaging a punched hole of the male plug locking the male plug to said receptor body, said elongated shaft being movable relative to the parallel prongs to a first position during said movement for permitting insertion and removal of the prongs relative to said locking element, said elongated shaft being movable relative to the parallel prongs to a second position during said movement in said receptor for urging said locking element into locking contact with a prong of the male plug, said elongated shaft having a variable width, and said elongated shaft having a greater width at said second position than in said first position.

9. The locking female receptor according to claim 8 wherein said receptor body forms an electrical wall unit.

* * * * *

US005413498C1

(12) EX PARTE REEXAMINATION CERTIFICATE (7954th)

United States Patent
Ursich

(10) Number: US 5,413,498 C1
(45) Certificate Issued: Jan. 4, 2011

(54) SELF-LOCKING FEMALE RECEPTOR FOR ELECTRICAL CORD

(76) Inventor: Nels E. Ursich, 6809 W. Brementowne Dr., Apt. 2W, Tinley Park, IL (US) 60477

Reexamination Request:
No. 90/010,596, Jul. 7, 2009

Reexamination Certificate for:

| | |
|---|---|
| Patent No.: | **5,413,498** |
| Issued: | **May 9, 1995** |
| Appl. No.: | **08/176,663** |
| Filed: | **Jan. 3, 1994** |

Related U.S. Application Data

(63) Continuation-in-part of application No. 07/911,752, filed on Jul. 10, 1992, now Pat. No. 5,281,162, which is a continuation of application No. 07/719,930, filed on Jun. 24, 1991, now Pat. No. 5,129,836.

(51) Int. Cl.
*H01R 4/50* (2006.01)

(52) U.S. Cl. ..... 439/346
(58) Field of Classification Search ..... None
See application file for complete search history.

(56) References Cited

U.S. PATENT DOCUMENTS

| | | | |
|---|---|---|---|
| 1,019,455 | A | 3/1912 | Graf |
| 2,373,083 | A | 4/1945 | Brewster |
| 2,654,073 | A | 9/1953 | Katz |
| 2,733,416 | A | 1/1956 | Evalt |
| 2,799,228 | A | 7/1956 | Farrell |
| 2,799,009 | A | 7/1957 | Benander |
| 2,816,471 | A | 12/1957 | Bachman |
| 2,968,205 | A | 1/1961 | Springate |
| 2,983,978 | A | 5/1961 | Wilgus |
| 3,046,827 | A | 7/1962 | Myers |
| 3,121,599 | A | 2/1964 | Modrey |
| 3,183,586 | A | 5/1965 | Sellers |
| 3,281,758 | A | 10/1966 | Appleton |
| 3,499,301 | A | 3/1970 | Niilola et al. |
| 3,543,218 | A | 11/1970 | Archer |
| 3,710,304 | A | 1/1973 | Warner et al. |
| 3,789,639 | A | 2/1974 | Canter |
| 3,835,675 | A | 9/1974 | Lippisch |
| 3,855,824 | A | 12/1974 | Falk |
| 3,891,289 | A | 6/1975 | Hanke |
| 3,914,965 | A | 10/1975 | Paxton |
| 3,952,565 | A | 4/1976 | Falk |
| 3,964,771 | A | 6/1976 | Baudouin |
| 4,061,409 | A | 12/1977 | Bealmear |
| 4,085,991 | A | 4/1978 | Marshall et al. |
| 4,136,919 | A | 1/1979 | Howard et al. |
| 4,167,658 | A | 9/1979 | Sherman |
| 4,230,386 | A | 10/1980 | Farnworth et al. |
| 4,317,392 | A | 3/1982 | Stephens et al. |
| 4,445,738 | A | 5/1984 | Wiencke |
| 4,566,297 | A | 1/1986 | Hawley |
| 4,578,611 | A | 3/1986 | Sadler |
| 4,627,681 | A | 12/1986 | Hong |
| 4,867,697 | A | 9/1989 | Borges |
| 5,005,057 | A | 4/1991 | Izumiya et al. |
| 5,055,057 | A | 10/1991 | Boyer |
| 5,169,326 | A | 12/1992 | Werner |
| 5,171,155 | A | 12/1992 | Mendoza |
| 5,352,123 | A | 10/1994 | Sample et al. |
| 5,470,252 | A | 11/1995 | Fladung |

FOREIGN PATENT DOCUMENTS

| | | | |
|---|---|---|---|
| DD | 0294999 | A5 | 10/1991 |
| DE | 2712836 | | 9/1977 |
| DE | 2726333 | | 12/1978 |
| EP | 0369872 | A2 | 5/1990 |
| EP | 0471603 | A1 | 2/1992 |
| WO | 9208259 | | 5/1992 |

*Primary Examiner*—Minh T Nguyen

(57) ABSTRACT

A female receptor for locking a male plug and having an actuator element accessible from an exterior position. The actuator element comprises an elongated shaft having an area of reduced width to permit disengaging movement of internal balls mounted in the receptor body. The ball and balls retain the prongs of the male plug in place when the area of reduced width of the rod is not aligned with the ball and balls.

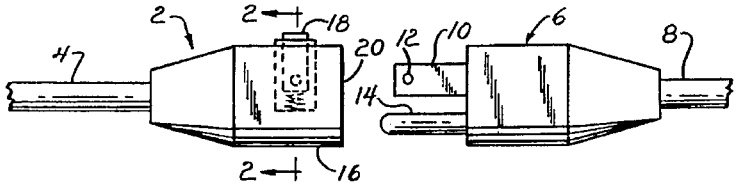

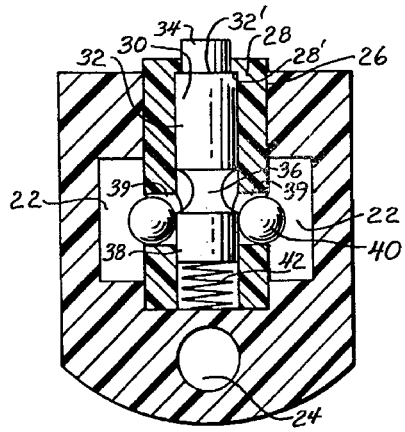

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-9 is confirmed.

New claims 10-17 are added and determined to be patentable.

*10. A locking female electrical receptor comprising a female receptor body having a pair of holes for receiving a male plug having spaced prongs with punched holes for electrically connecting two electrical lines respectively coupled to said receptor body and the male plug, wherein the two electrical lines extend through an opening in the female electrical receptor,*

*said receptor body having actuator means mounted for selective relative movement within said receptor body,*

*said actuator means having a manually operated element being accessible from the outside of said receptor body,*

*a pair of locking elements mounted in said receptor body in operative relationship to said actuator means at a position between the spaced prongs for selectively engaging the punched holes of the male plug locking the prongs of the male plug to said receptor body,*

*said actuator means being movable along an axis parallel to the spaced prong to a first position between the spaced prongs for permitting insertion and removal of the prongs relative to said locking elements, and*

*said actuator means being movable along said axis parallel to the spaced prongs to a second position between the spaced prongs in said receptor for rigidly urging said pair of locking elements outward in opposite directions into locking contact with the prongs of the male plug, said manual element having a greater width at said second position than at said first position.*

*11. A locking female electrical receptor comprising a female receptor body having a pair of holes for receiving a male plug having spaced prongs with punched holes for electrically connecting two electrical lines respectively coupled to said receptor body and the male plug, wherein the two electrical lines extend through an opening in the female electrical receptor,*

*said receptor body having an actuator mounted for selective relative movement within said receptor body,*

*said actuator having a manually operated element being accessible from the outside of said receptor body,*

*a pair of locking elements mounted in said receptor body in operative relationship to said actuator at a position between the spaced prongs for selectively engaging the punched holes of the male plug locking the prongs of the male plug to said receptor body,*

*said actuator being movable along an axis parallel to the spaced prong to a first position between the spaced prongs for permitting insertion and removal of the prongs relative to said locking elements, and*

*said actuator being movable along said axis parallel to the spaced prongs to a second position between the spaced prongs in said receptor for rigidly urging said pair of locking elements outward in opposite directions into locking contact with the prongs of the male plug, said manual element having a greater width at said second position than at said first position.*

*12. A locking female electrical receptor comprising a receptor body having holes for receiving the spaced generally parallel prongs having punched holes of a male plug for electrically connecting an electrical line to a power source, wherein the electrical line extends through an opening in the female electrical receptor,*

*said receptor body having actuator means mounted for selective relative movement within said socket receptor body,*

*said actuator means being an elongated shaft extending into said receptor body and having an end portion positioned between said holes of said receptor body, said elongated shaft having an external portion accessible from the outside of said socket receptor body for manually causing said movement relative to said receptor body,*

*at least one locking element mounted in said receptor body in operative relationship to said actuator means for selectively engaging at least one of the punched holes of the male plug locking the male plug to said receptor body,*

*said elongated shaft being movable along an axis in parallel relationship to the parallel prongs to a first position during said movement for permitting insertion and removal of the prongs relative to said locking elements,*

*said elongated shaft being movable along an axis in parallel relationship to the parallel prongs to a second position during said movement in said receptor for urging said at least one locking element into locking contact with at least one prong of the male plug,*

*said elongated shaft having a variable width, and*

*said elongated shaft having a greater width at said second position than in said first position.*

*13. A locking female electrical receptor comprising a receptor body having holes for receiving the spaced generally parallel prongs having punched holes of a male plug for electrically connecting an electrical line to a power source, wherein the electrical line extends through an opening in the female electrical receptor,*

*said receptor body having an actuator mounted for selective relative movement within said socket receptor body,*

*said actuator being an elongated shaft extending into said receptor body and having an end portion positioned between said holes of said receptor body, said elongated shaft having an external portion accessible from the outside of said socket receptor body for manually causing said movement relative to said receptor body,*

*at least one locking element mounted in said receptor body in operative relationship to said actuator for selectively engaging at least one of the punched holes of the male plug locking the male plug to said receptor body,*

*said elongated shaft being movable along an axis in parallel relationship to the parallel prongs to a first position during said movement for permitting insertion and removal of the prongs relative to said locking elements,*

*said elongated shaft being movable along an axis in parallel relationship to the parallel prongs to a second position during said movement in said receptor for urging said at least one locking element into locking contact with at least one prong of the male plug,*

*said elongated shaft having a variable width, and*

*said elongated shaft having a greater width at said second position than in said first position.*

*14. A locking female electrical receptor comprising a receptor body having holes for receiving the spaced, generally parallel prongs having punched holes of a male plug for electrically connecting an electrical line to a power source, wherein the electrical line extends through an opening in the female electrical receptor,*

*said receptor body having actuator means mounted for selective relative movement within said socket receptor body,*

*said actuator means being an elongated shaft extending into said receptor body and having an end portion positioned within said receptor body, said elongated shaft having an external portion accessible from the outside of said socket receptor body for manually causing said movement relative to said receptor body,*

*a locking element mounted in said receptor body in operative relationship to said actuator means for selectively engaging a punched hole of the male plug locking the male plug to said receptor body,*

*said elongated shaft being movable along an axis in parallel relationship to the parallel prongs to a first position during said movement for permitting insertion and removal of the prongs relative to said locking element,*

*said elongated shaft being movable along an axis generally in parallel relationship to the parallel prongs to a second position during said movement in said receptor for urging said locking element into locking contact with a prong of the male plug,*

*said elongated shaft having a variable width, and*

*said elongated shaft having a greater width at said second position than in said first position.*

*15. A locking female electrical receptor comprising a receptor body having holes for receiving the spaced, generally parallel prongs having punched holes of a male plug for electrically connecting an electrical line to a power source, wherein the electrical line extends through an opening in the female electrical receptor,*

*said receptor body having an actuator mounted for selective relative movement within said socket receptor body,*

*said actuator being an elongated shaft extending into said receptor body and having an end portion positioned within said receptor body, said elongated shaft having an external portion accessible from the outside of said socket receptor body for manually causing said movement relative to said receptor body,*

*a locking element mounted in said receptor body in operative relationship to said actuator for selectively engaging a punched hole of the male plug locking the male plug to said receptor body,*

*said elongated shaft being movable along an axis in parallel relationship to the parallel prongs to a first position during said movement for permitting insertion and removal of the prongs relative to said locking element,*

*said elongated shaft being movable along an axis generally in parallel relationship to the parallel prongs to a second position during said movement in said receptor for urging said locking element into locking contact with a prong of the male plug,*

*said elongated shaft having a variable width, and*

*said elongated shaft having a greater width at said second position than in said first position.*

*16. A locking female electrical receptor comprising a receptor body having holes for receiving the spaced, generally parallel prongs having punched holes of a male plug for electrically connecting an electrical line to a power source, wherein the electrical line extends through an opening in the female electrical receptor,*

*said receptor body having actuator means mounted for selective relative movement within said socket receptor body,*

*said actuator means being an elongated shaft extending into said receptor body and having an end portion positioned within said receptor body, said elongated shaft having an external portion accessible from the outside of said socket receptor body for manually causing said movement relative to said receptor body,*

*a locking element mounted in said receptor body in operative relationship to said actuator for selectively engaging a punched hole of the male plug locking the male plug to said receptor body,*

*said elongated shaft being movable relative to the parallel prongs to a first position during said movement for permitting insertion and removal of the prongs relative to said locking element,*

*said elongated shaft being movable relative to the parallel prongs to a second position during said movement in said receptor for urging said locking element into locking contact with a prong of the male plug,*

*said elongated shaft having a variable width, and*

*said elongated shaft having a greater width at said second position than in said first position.*

*17. A locking female electrical receptor comprising a receptor body having holes for receiving the spaced, generally parallel prongs having punched holes of a male plug for electrically connecting an electrical line to a power source, wherein the electrical line extends through an opening in the female electrical receptor,*

*said receptor body having an actuator mounted for selective relative movement within said socket receptor body,*

*said actuator being an elongated shaft extending into said receptor body and having an end portion positioned within said receptor body, said elongated shaft having an external portion accessible from the outside of said socket receptor body for manually causing said movement relative to said receptor body,*

*a locking element mounted in said receptor body in operative relationship to said actuator for selectively engaging a punched hole of the male plug locking the male plug to said receptor body,*

*said elongated shaft being movable relative to the parallel prongs to a first position during said movement for permitting insertion and removal of the prongs relative to said locking element,*

*said elongated shaft being movable relative to the parallel prongs to a second position during said movement in said receptor for urging said locking element into locking contact with a prong of the male plug,*

*said elongated shaft having a variable width, and*

*said elongated shaft having a greater width at said second position than in said first position.*

* * * * *